US007455623B2

(12) United States Patent
Wang

(10) Patent No.: US 7,455,623 B2
(45) Date of Patent: Nov. 25, 2008

(54) ELLIPTICAL MACHINE

(75) Inventor: Shih-Peng Wang, Taichung Hsien (TW)

(73) Assignee: P & F Brother Industrial Corporation, Taichung (TW)

( * ) Notice: Subject to any disclaimer, the term of this patent is extended or adjusted under 35 U.S.C. 154(b) by 71 days.

(21) Appl. No.: 11/649,410

(22) Filed: Jan. 4, 2007

(65) Prior Publication Data

US 2008/0167164 A1 Jul. 10, 2008

(51) Int. Cl.
*A63B 22/04* (2006.01)
*A63B 22/12* (2006.01)

(52) U.S. Cl. ..... 482/52; 482/57

(58) Field of Classification Search ..... 482/51–53, 482/57, 62, 127
See application file for complete search history.

(56) References Cited

U.S. PATENT DOCUMENTS 3,475,021 A * 10/1969 Ruegsegger ..... 482/71
5,336,141 A * 8/1994 Vittone ..... 482/51
5,967,944 A * 10/1999 Vittone et al. ..... 482/52
6,231,484 B1 * 5/2001 Gordon ..... 482/71
6,234,935 B1 * 5/2001 Chu ..... 482/51
6,277,055 B1 * 8/2001 Birrell et al. ..... 482/52
2005/0272562 A1 * 12/2005 Alessandri et al. ..... 482/52
2006/0046902 A1 * 3/2006 Chang ..... 482/52
2006/0293153 A1 * 12/2006 Porth et al. ..... 482/52

* cited by examiner

*Primary Examiner*—Steve R Crow
(74) *Attorney, Agent, or Firm*—Frommer Lawrence & Haug LLP; Ronald R. Santucci

(57) ABSTRACT

An elliptical machine includes: a machine body including a first support structure, and a second support structure extending upwardly from the first support structure; left and right cranks mounted rotatably to the first support structure and rotatable about a first rotation axis; a swing unit including left and right rotary shafts mounted rotatably and respectively to opposite sides of the second support structure, and left and right handles mounted respectively to the left and right rotary shafts, the left and right rotary shafts being respectively rotatable about second and third rotation axes, each of which is inclined to a line parallel to the first rotation axis; and a pedal unit including left and right pedal rods, each of which is connected rotatably to a respective one of the left and right handles and a respective one of the left and right cranks.

7 Claims, 5 Drawing Sheets

ELLIPTICAL MACHINE

BACKGROUND OF THE INVENTION

1. Field of the Invention

The invention relates to an elliptical machine, more particularly to an elliptical machine that permits twisting movements of an upper body of a user.

2. Description of the Related Art

As shown in FIG. 1, a conventional elliptical machine 1 includes a machine body 11, a transmission unit 12, a handle unit 13, and a pedal unit 14.

The machine body 11 includes a support base 111, and an upright structure 112 extending upwardly from the support base 111. The transmission unit 12 is mounted rotatably to the support base 111, and is rotatable about a reference axis 15. The transmission unit 12 is disposed on a virtual vertical plane 16, which is perpendicular to the reference axis 15.

The handle unit 13 includes a rotary shaft 131 mounted rotatably on the upright structure 112, and left and right handles 133, 134 disposed on two opposite ends of the rotary shaft 131. The rotary shaft 131 has a rotation axis 135 that is parallel to the reference axis 15.

The pedal unit 14 includes a left pedal rod 141 and a right pedal rod 142. Each of the left and right pedal rods 141, 142 is pivoted to a respective one of the left and right handles 133, 134 at one end, and is pivoted to the transmission unit 12 at the other end. The left and right pedal rods 141, 142 are respectively disposed on two opposite sides of the virtual vertical plane 16. Foot plates 1411, 1421 of the left and right pedal rods 141, 142 respectively move along vertical elliptical paths that extend in planes parallel to the virtual vertical plane 16.

The left and right pedal rods 141, 142 of the conventional elliptical machine 1 can allow a user's feet to move along the vertical elliptical paths so as to achieve the effects of exercise. However, since the rotation axis 135 of the rotary shaft 131 is parallel to the reference axis 15, and since the handle unit 13, the pedal unit 14, and the transmission unit 12 are pivoted to each other using simple pivot connections, the left and right pedal rods 141, 142 merely swing back and forth along the vertical elliptical paths. Consequently, the amount of exercise the user obtains from using the conventional elliptical machine 1 is limited. That is, only a small number of the muscles on the upper and lower legs are exercised, and only a minimal exertion is required by the user in exercising these muscles

SUMMARY OF THE INVENTION

Therefore, the object of the present invention is to provide an elliptical machine that provides better exercise to the user as compared to the prior art.

According to one aspect of the present invention, there is provided an elliptical machine that includes a machine body, a transmission unit, a swing unit, and a pedal unit.

The machine body includes a first support structure, and a second support structure extending upwardly from the first support structure.

The transmission unit includes left and right cranks mounted rotatably to the first support structure and rotatable about a substantially horizontal first rotation axis.

The swing unit includes left and right rotary shafts, and left and right handles. The left and right rotary shafts are mounted rotatably and respectively to two opposite sides of the second support structure. Each of the left and right handles has an intermediate part mounted to a respective one of the left and right rotary shafts. The left and right rotary shafts are respectively rotatable about substantially horizontal second and third rotation axes, each of which is inclined to a line parallel to the first rotation axis.

The pedal unit includes left and right pedal rods, each of which is connected rotatably to a respective one of the left and right handles and a respective one of the left and right cranks.

According to another aspect of the present invention, there is provided an elliptical machine that includes a machine body, left and right cranks, a swing unit, and left and right pedal rods.

The machine body includes a first support structure having front and rear ends, and a second support structure extending upwardly from the first support structure.

The left and right cranks are mounted rotatably to the first support structure on two opposite sides of an imaginary vertical plane, which extends in a front-to-rear direction.

The swing unit includes left and right rotary shafts, and left and right handles. The left and right rotary shafts are mounted rotatably to two opposite sides of the second support structure on the opposite sides of the imaginary vertical plane. Each of the left and right handles has an intermediate part mounted to a respective one of the left and right rotary shafts.

Each of the left and right pedal rods is connected to a respective one of the left and right handles and a respective one of the left and right cranks. The left and right pedal rods respectively have left and right foot plates thereon. The left foot plate is movable along a left elliptical path that has a forward portion extending to a right side of the imaginary vertical plane and a rear portion extending at a left side of the imaginary vertical plane. The right foot plate is movable along a right elliptical path that has a forward portion extending to the left side of the imaginary vertical plane, and a rear portion extending at the right side of the imaginary vertical plane.

According to yet another aspect of the present invention, there is provided an elliptical machine that includes a machine body, left and right cranks, a swing unit, and left and right pedal rods.

The machine body includes a first support structure, and a second support structure extending upwardly from the first support structure.

The left and right cranks are mounted rotatably to the first support structure.

The swing unit includes left and right rotary shafts mounted rotatably and respectively to two opposite sides of the second support structure, and left and right handles, each of which has an intermediate part mounted to a respective one of the left and right rotary shafts.

Each of the left and right pedal rods is connected to a respective one of the left and right handles and a respective one of the left and right cranks. The left pedal rod moves rightward and forward and the right pedal rod moves rightward and rearward when the left handle moves leftward and rearward and when the right handle moves leftward and forward. The left pedal rod moves leftward and rearward and the right pedal rod moves leftward and forward when the left handle moves rightward and forward and when the right handle moves rightward and rearward.

BRIEF DESCRIPTION Of THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
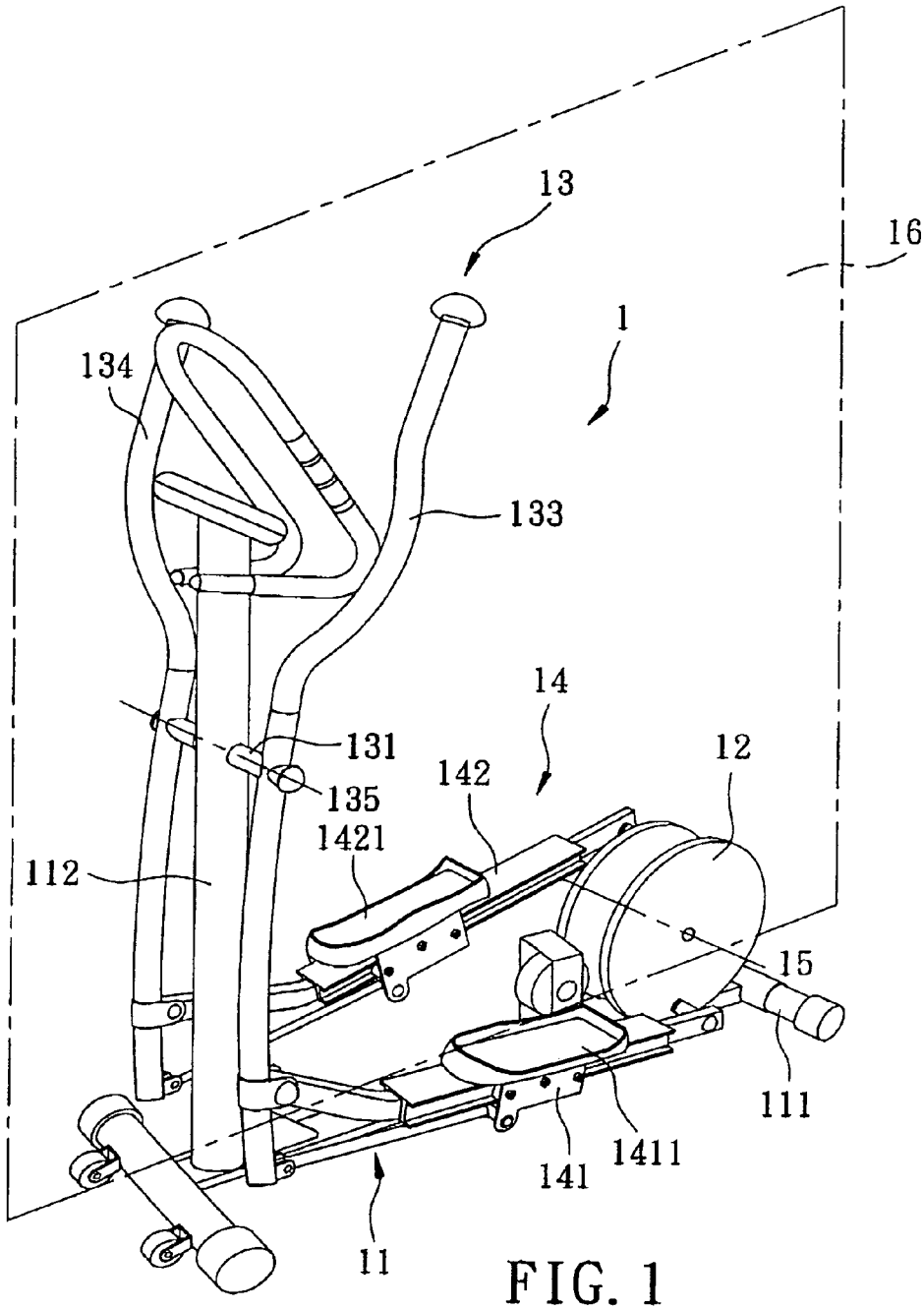
FIG. 1 PRIOR ART
FIG. 1 is a perspective view of a conventional elliptical machine.
Figure 2:
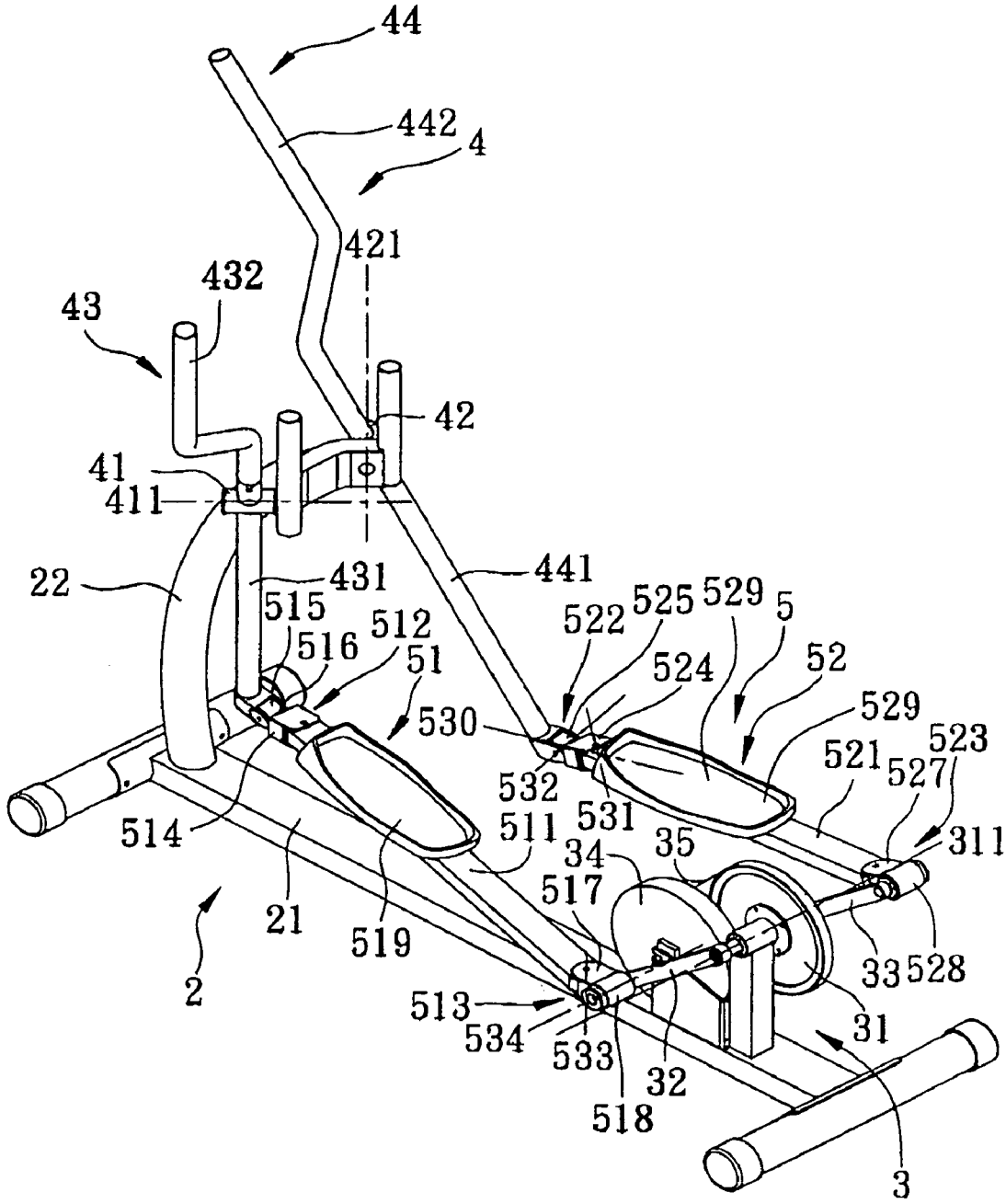
FIG. 2 is a perspective view of the preferred embodiment of an elliptical machine according to the present invention.
Figure 3:
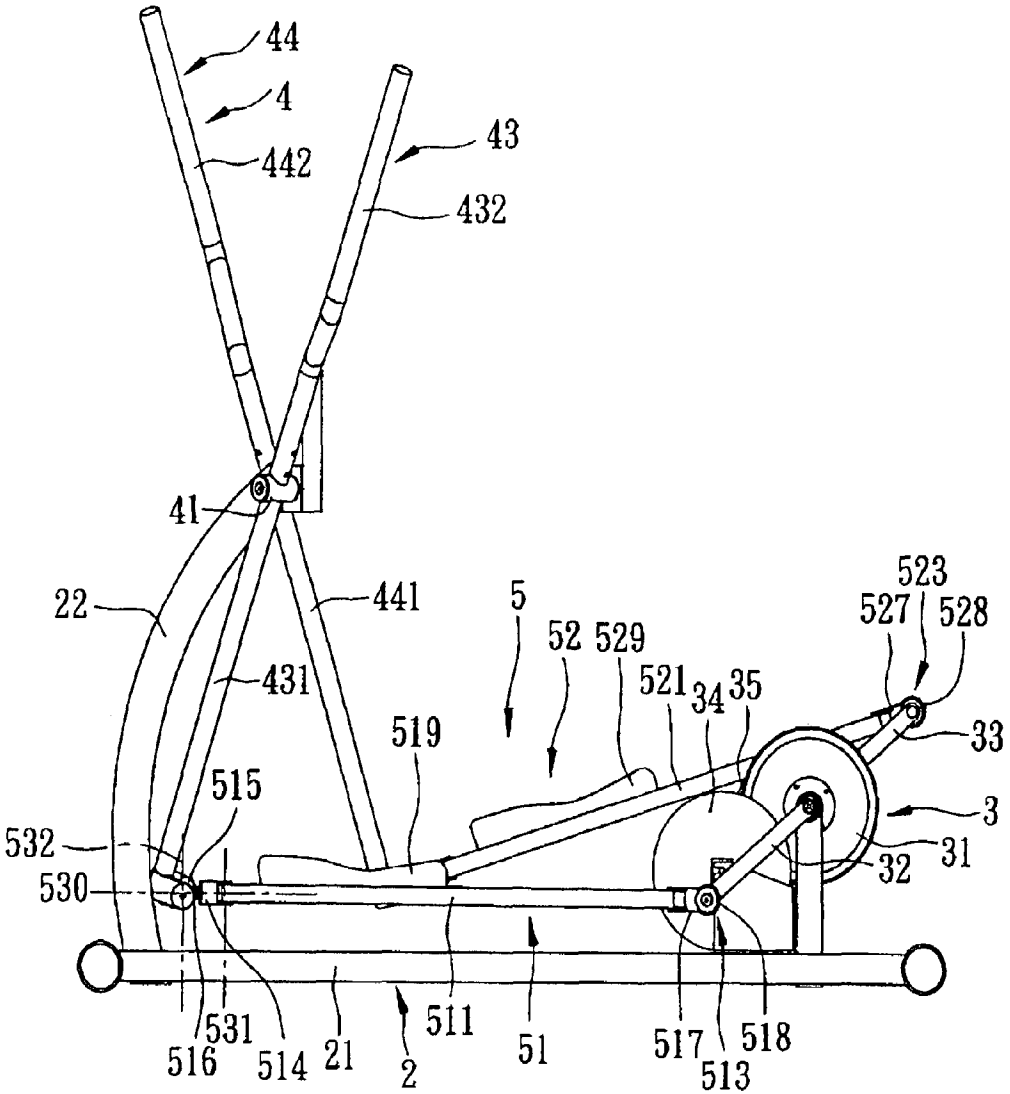
FIG. 3 is a side view of the preferred embodiment, illustrating coupling relationships among a swing unit, a pedal unit, and a transmission unit.
Figure 4:
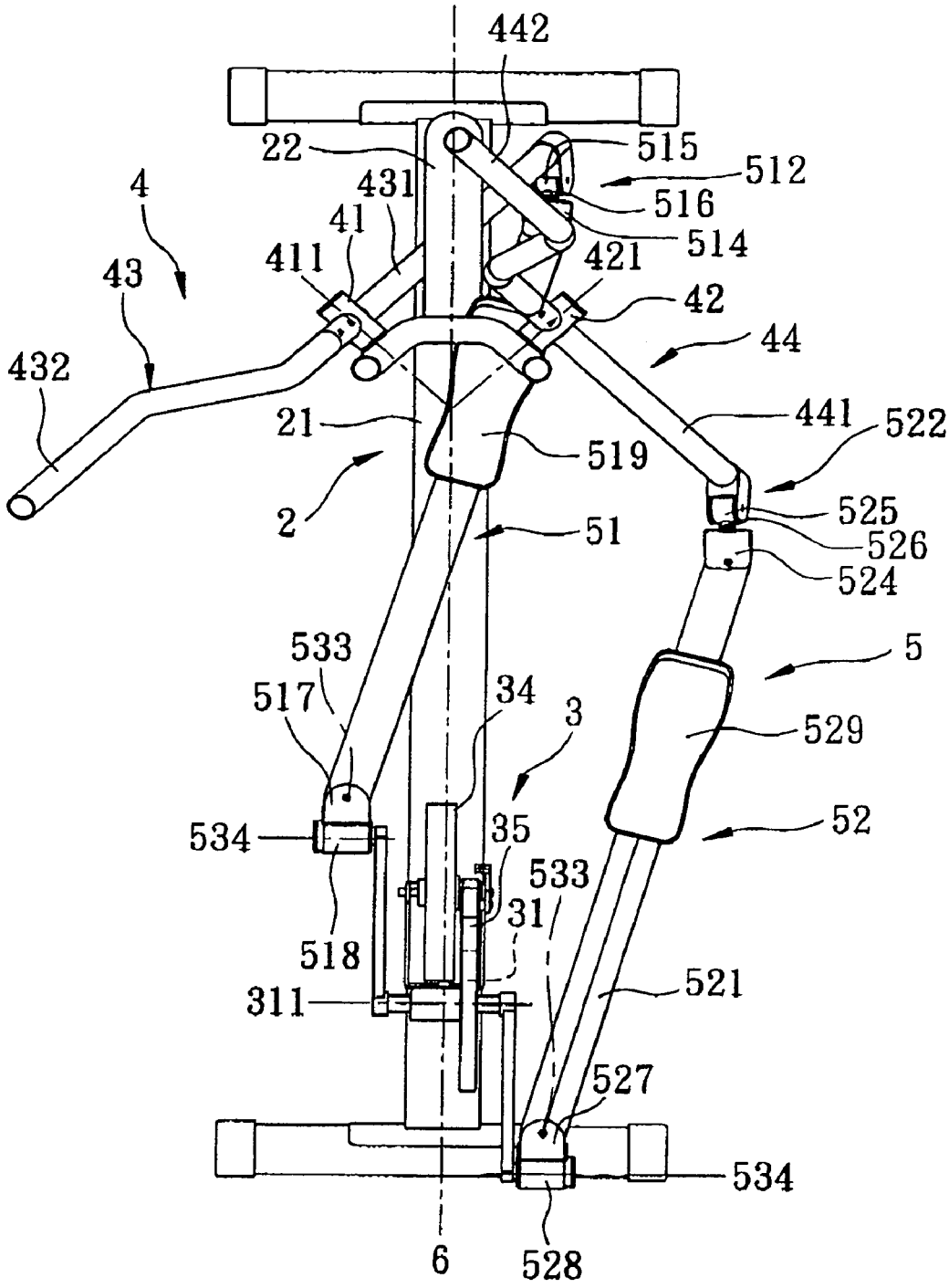
FIG. 4 is a top view of the preferred embodiment, where the elliptical machine is disposed at a first waist-twisting position.

As shown in FIG. 2, FIG. 3 and FIG. 4, the preferred embodiment of an elliptical machine according to the present invention includes a machine body 2, a transmission unit 3, a swing unit 4, and a pedal unit 5.

The machine body 2 includes a first support structure 21, and a second support structure 22 extending upwardly from the first support structure 21. In this embodiment, the first support structure 21 has front and rear ends, and the second support structure 22 is disposed proximate to the front end of the first support structure 21. The transmission unit 3 includes a drive wheel 31 that is mounted rotatably to a rear portion of the first support structure 21, left and right cranks 32, 33 that are respectively connected to left and right sides of the drive wheel 31, a flywheel 34 that is mounted rotatably to the first support structure 21, and a transmission belt 35 that interconnects the drive wheel 31 and the flywheel 34. The left and right cranks 32, 33 are rotatable along with the drive wheel 31 and about a substantially horizontal first rotation axis 311. The first rotation axis 311 is perpendicular to an imaginary vertical plane 6 (see FIG. 4) that extends in a front-to-rear direction. In other words, the first rotation axis 311 extends in a left-to-right direction. The left and right cranks 32, 33 are disposed on two opposite sides of the imaginary vertical plane 6.

The swing unit 4 includes left and right rotary shafts 41, 42, and left and right handles 43, 44. The left and right rotary shafts 41, 42 are mounted rotatably and respectively to two opposite sides of the second support structure 22. Each of the left and right handles 43, 44 has an intermediate part that is mounted to a respective one of the left and right rotary shafts 41, 42. The left and right rotary shafts 41, 42 are respectively rotatable about substantially horizontal second and third rotation axes 411, 421. Each of the second and third rotation axes 411, 421 is inclined to a line parallel to the first rotation axis 311. In other words, the left rotary shaft 41 extends leftward and forward from the second support structure 22, and the right rotary shaft 42 extends rightward and forward from the second support structure 22. In addition, the left and right rotary shafts 41, 42 are disposed symmetrically relative to the imaginary vertical plane 6. The left and right handles 43, 44 are respectively disposed on the two opposite sides of the imaginary vertical plane 6. Each of the left and right handles 43, 44 has an upper grip section 432, 442 extending upwardly from the intermediate part, and a lower section 431, 441 extending downwardly from the intermediate part.

The pedal unit 5 includes left and right pedal rods 51, 52, each of which is connected rotatably to a respective one of the left and right handles 43, 44 and a respective one of the left and right cranks 32, 33.

The left and right pedal rods 51, 52 are disposed on the two opposite sides of the imaginary vertical plane 6, respectively. Each of the left and right pedal rods 51, 52 includes a rod body 511, 521 having a foot plate 519, 529 formed thereon. A user places his or her feet respectively on the foot plates 519, 529. The pedal unit 5 further includes two universal connectors 512, 522, and two universal couplers 513, 523.

Each of the universal connectors 512, 522 connects a respective one of the left and right pedal rods 51, 52 to the respective one of the left and right handles 43, 44. Each of the universal connectors 512, 522 has first, second and third pivot axes 531, 532, 530 that are perpendicular to each other. Each of the left and right pedal rods 51, 52 is turnable about the first, second and third pivot axes 531, 532, 530 so as to rotate relative to the respective one of the left and right handles 43, 44. In particular, each of the universal connectors 512, 522 includes a pedal pivot block 514, 524 pivoted to a forward end of the respective one of the left and right pedal rods 51, 52 about the first pivot axis 531, a handle pivot block 515, 525 pivoted to a bottom end of the lower section 431, 441 of the respective one of the left and right handles 43, 44 about the second pivot axis 532, and a bridge block 516, 526 connected between the respective pedal pivot block 514, 524 and the respective handle pivot block 515, 525. Each of the bridge block 516, 526 is rotatable relative to the pedal pivot block 514, 524 about the respective third pivot axis 530.

Each of the universal couplers 513, 523 connects a respective one of the left and right pedal rods 51, 52 to the respective one of the left and right cranks 32, 33. Each of the universal couplers 513, 523 has fourth and fifth pivot axes 533, 534 that are perpendicular to each other. In particular, each of the universal couplers 513, 523 includes a pedal pivot portion 517, 527 pivoted to a rear end of the rod body 511, 521 of the respective one of the left and right pedal rods 51, 52 about the respective fourth pivot axis 533, and a crank pivot portion 518, 528 pivoted to the respective one of the left and right cranks 32, 33 about the respective fifth pivot axis 534.

Figure 5:
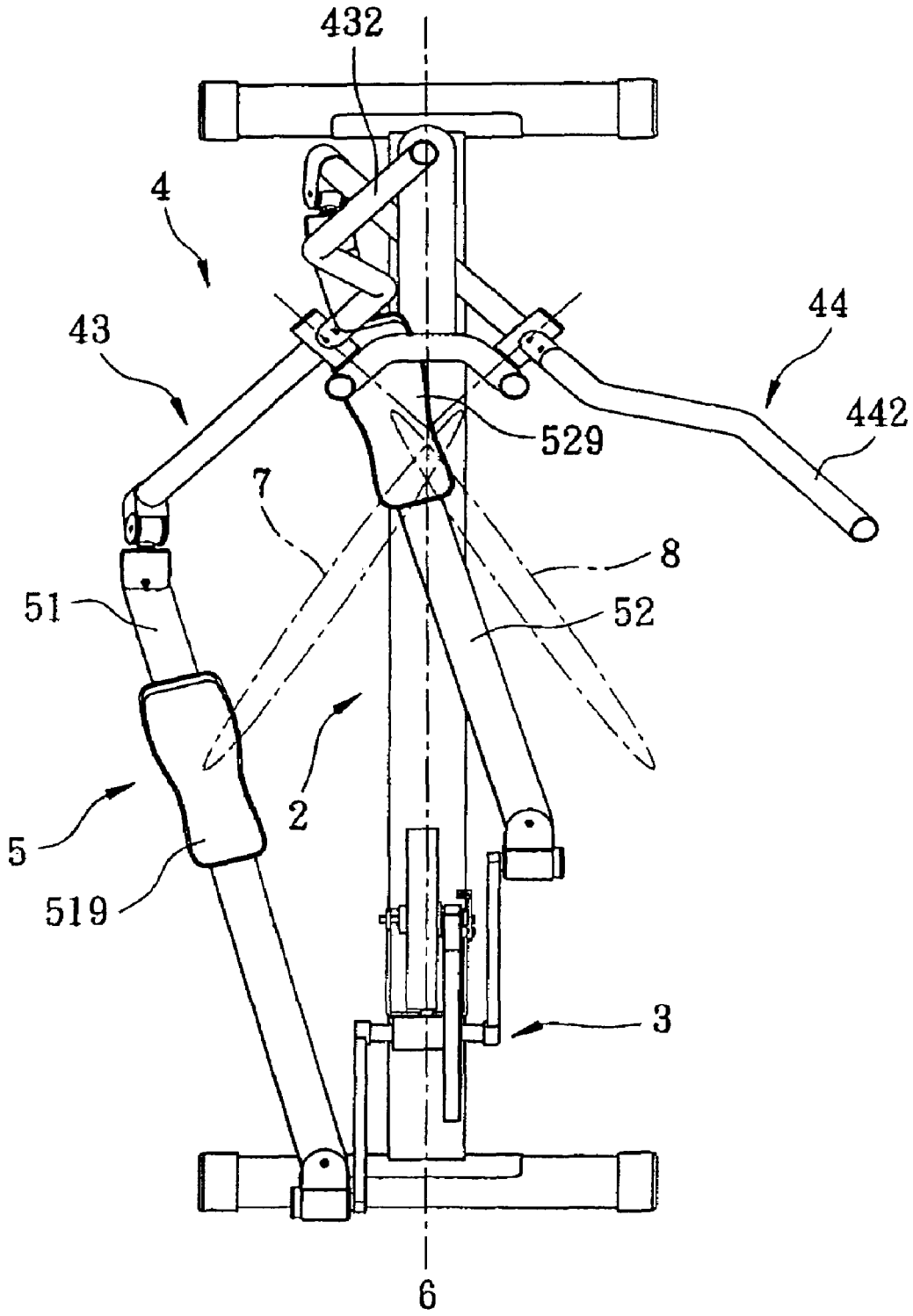
FIG. 5 is a top view of the preferred embodiment similar to FIG. 4, where the elliptical machine is disposed at a second waist-twisting position.

Referring to FIG. 4 and FIG. 5, the foot plate 519 of the left pedal rod 51 is movable along a left elliptical path 7 that has a forward portion extending to a right side of the imaginary vertical plane 6 and a rear portion extending at a left side of the imaginary vertical plane 6. The foot plate 529 of the right pedal rod 52 is movable along a right elliptical path 8 that has a forward portion extending to the left side of the imaginary vertical plane 6, and a rear portion extending at the right side of the imaginary vertical plane 6.

The elliptical machine is operable between a first waist-twisting position (see FIG. 4), where the left handle 43 is moved leftward and rearward, and the right handle 44 is moved leftward and forward, and a second waist-twisting position (see FIG. 5), where the left handle 43 is moved rightward and forward, and the right handle 44 is moved rightward and rearward.

In operation, when the left hand of the user moves the left handle 43 leftward and rearward, the left pedal rod 51 is moved rightward and forward, bringing the left foot of the user rightward and forward. When the right hand of the user moves the right handle 44 leftward and forward, the right pedal rod 52 is moved rightward and rearward, bringing the right foot of the user rightward and rearward. Therefore, when the elliptical machine is disposed at the first waist-twisting position, the upper body of the user is forced to face left, while the lower body of the user is moved right, resulting in a waist twisting gesture.

When the left hand of the user moves the left handle 43 rightward and forward, the left pedal rod 51 is moved leftward and rearward, bringing the left foot of the user leftward and rearward. When the right hand of the user moves the right handle 44 rightward and rearward, the right pedal rod 52 is moved leftward and forward, bringing the right foot of the user leftward and forward. Therefore, when the elliptical machine is disposed at the second waist-twisting position, the upper body of the user is forced to face right, while the lower body of the user is moved left, resulting in another waist twisting gesture.

The elliptical machine according to the present invention not only provides a back and forth movement to the user, but since the second and third rotation axes 411, 421 of the left and right rotary shafts 41, 42 are inclined to the first rotation axis 311, the elliptical machine is also capable of providing leftward and rightward movement to the user. Consequently, other than exercising both the inner and outer muscles of the upper and lower legs, muscles around the waist also get exercised. Furthermore, a significant amount of exertion is required by the user in exercising these muscles.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. An exercise machine comprising:

a machine body including a first support structure, and a second support structure extending upwardly from said first support structure;

a transmission unit including left and right cranks mounted rotatably to said first support structure and rotatable about a substantially horizontal first rotation axis;

a swing unit including left and right rotary shafts mounted rotatably and respectively to two opposite sides of said second support structure, and left and right handles, each of which has an intermediate part mounted to a respective one of said left and right rotary shafts, said left and right rotary shafts being respectively rotatable about a substantially horizontal second and third rotation axes, each of said second and third rotation axes being inclined to a line parallel to said first rotation axis; and a pedal unit including left and right pedal rods, each of which is connected rotatably to a respective one of said left and right handles and a respective one of said left and right cranks, and is provided with a foot plate;

wherein said first support structure has front and rear ends, said second support structure being disposed proximate to said front end, said first rotation axis extending in a left-to-fight direction, said left rotary shaft of said swing unit extending leftward and forward from said second support structure, said right rotary shaft of said swing unit extending rightward and forward from said second support structure, said pedal unit further including two universal connectors, each of which connects a respective one of said left and right pedal rods to the respective of said left and right handles, each of said universal connectors having first, second and third pivot axes which are substantially perpendicular to each other, each of said left and right pedal rods being turnable about said first, second and third pivot axes so as to rotate relative to the respective one of said left and right handles.

2. The exercise machine as claimed in claim 1, wherein each of said universal connectors includes a pedal pivot block pivoted to a forward end of the respective one of said left and right pedal rods about said first pivot axis, a handle pivot block pivoted to a bottom end of the respective one of said left and right handles about said second pivot axis, and a bridge block connected between said pedal pivot block and said handle pivot block, said bridge block being rotatable relative to said pedal pivot block about said third pivot axis.

3. An exercise machine comprising:

a machine body including a first support structure, and a second support structure extending upwardly from said first support structure;

a transmission unit including left and right cranks mounted rotatably to said first support structure and rotatable about a substantially horizontal first rotation axis;

a swing unit including left and right rotary shafts mounted rotatably and respectively to two opposite sides of said second support structure, and left and right handles, each of which has an intermediate part mounted to a respective one of said left and right rotary shafts, said left and right rotary shafts being respectively rotatable about substantially horizontal second and third rotation axes, each of said second and third rotation axes being inclined to a line parallel to said first rotation axis; and a pedal unit including left and right pedal rods, each of which is connected rotatably to a respective one of said left and right handles and a respective one of said left and right cranks, and is provided with a foot plate;

wherein said first support structure has front and rear ends, said second support structure being disposed proximate to said front end, said first rotation axis extending in a left-to-right direction, said left rotary shaft of said swing unit extending leftward and forward from said second support structure, said right rotary shaft of said swing unit extending rightward and forward from said second support structure, said pedal unit further including two universal couplers, each of which connects a respective one of said left and right pedal rods to the respective one of said left and right cranks, each of said universal couplers having fourth and fifth pivot axes which are substantially perpendicular to each other.

4. The exercise machine as claimed in claim 3, wherein each of said universal couplers includes a pedal pivot portion pivoted to a rear end of the respective one of said left and right pedal rods about said fourth pivot axis, and a crank pivot portion pivoted to the respective one of said left and right cranks about said fifth pivot axis.

5. An elliptical machine comprising:

a machine body including a first support structure which has front and rear ends, and a second support structure which extends upwardly from said first support structure;

left and right cranks mounted rotatably to said first support structure on two opposite sides of an imaginary vertical plane which extends in a front-to-rear direction;

a swing unit including left and right rotary shafts which are mounted rotatably to two opposite sides of said second support structure on the opposite sides of the imaginary vertical plane, and left and right handles, each of which has an intermediate part mounted to a respective one of said left and right rotary shafts; and left and right pedal rods, each of which is connected to a respective one of said left and right handles and a respective one of said left and right cranks, said left and right pedal rods respectively having left and right foot plates thereon, said left foot plate being movable along a left elliptical path that has a forward portion extending to a right side of the imaginary vertical plane and a rear portion extending at a left side of the imaginary vertical plane, said right foot plate being movable along a right elliptical path that has a forward portion extending to the left side of the imaginary vertical plane, and a rear portion extending at the right side of the imaginary vertical plane.

6. An exercise machine comprising:

a machine body including a first support structure, and a second support structure extending upwardly from said first support structure;

left and right cranks mounted rotatably to said first support structure;

a swing unit including left and right rotary shafts mounted rotatably and respectively to two opposite sides of said second support structure, and left and right handles, each of which has an intermediate part mounted to a respective one of said left and right rotary shafts; and left and right pedal rods, each of which is connected to a respective one of said left and right handles and a respective one of said left and right cranks;

wherein said left pedal rod moves rightward and forward and said right pedal rod moves rightward and rearward when said left handle moves leftward and rearward and when said right handle moves leftward and forward, and wherein said left pedal rod moves leftward and rearward and said right pedal rod moves leftward and forward when said left handle moves rightward and forward and when said right handle moves rightward and rearward.

7. The exercise machine as claimed in claim 6, wherein said left and right rotary shafts of said swing unit are inclined to each other.

* * * * *